United States Patent [19]

Bouy et al.

[11] 4,222,842

[45] Sep. 16, 1980

[54] ELECTRODE FOR ELECTROLYSIS

[75] Inventors: Pierre Bouy, Enghien les Bains; Dominique Ravier, Paris, both of France

[73] Assignee: Rhone-Poulenc Industries, Paris, France

[21] Appl. No.: 18,150

[22] Filed: Mar. 7, 1979

[30] Foreign Application Priority Data

Mar. 13, 1978 [FR] France ..... 78 07093

[51] Int. Cl.[2] ..... C25B 11/10; B32B 15/04; C25B 1/34

[52] U.S. Cl. ..... 204/290 F; 427/126.6; 428/472

[58] Field of Search ..... 204/290 F; 427/126

[56] References Cited

U.S. PATENT DOCUMENTS

| | | | |
|---|---|---|---|
| 2,401,326 | 6/1946 | Archibald et al. | 423/647 |
| 3,399,966 | 9/1968 | Suzuki et al. | 204/290 F X |
| 3,732,157 | 5/1973 | De Witt | 204/268 |
| 3,977,958 | 8/1976 | Caldwell et al. | 204/252 |
| 4,029,566 | 6/1977 | Brandmair et al. | 204/290 F |
| 4,078,988 | 3/1978 | Brandmair et al. | 204/286 |
| 4,140,813 | 2/1979 | Hund et al. | 427/34 |

FOREIGN PATENT DOCUMENTS 1438462 6/1976 United Kingdom .

OTHER PUBLICATIONS

Hepworth et al, Trans. Metallurgical Soc. of AIME, vol. 224, pp. 928–935, 10/62.

*Primary Examiner*—F. C. Edmundson

[57] ABSTRACT

Electrodes for electrolysis are provided comprising a valve-metal substrate and having an active surface which does not employ precious metals, said active surface comprising cobalt oxide and an oxygen or hydrogen compound of titanium in which said titanium has a valence less than 3. The electrode is particularly useful as anode in the electrolysis of sodium chloride.

11 Claims, No Drawings

ELECTRODE FOR ELECTROLYSIS

BACKGROUND OF THE INVENTION

The present invention relates to electrodes for electrolysis, particularly the electrolysis of sodium chloride, said electrodes having a coating of cobalt and titanium compounds.

For the last 20 years or so, metal anodes have been used more and more commonly for the electrolysis of sodium chloride, both in mercury cells and in diaphragm or membrane cells, and both for the production of chlorine and of soda and for the production of oxygen derivatives, such as the chlorates. The anodes used in industry generally comprise a substrate, generally of titanium, covered with metals of the platinum group or their oxides, possibly mixed with oxides of other metals, particularly titanium in rutile form, which oxide is formed furthermore in situ during use of the electrode in electrolysis. The use of precious metals results in large monetary investments in the erection of manufacturing facilities. Furthermore, the consumption of these expensive metals, although low in weight, reaches an amount which is not negligible as compared with the value of the products of the electrolysis. It is, therefore, completely understandable that numerous attempts have been made to replace the metals of the platinum group with compounds of non-precious metals. Among these compounds, cobalt oxide has been mentioned, for instance, in U.S. Pat. Nos. 3,399,966 and 3,977,958. No publication is known concerning the industrial development of such electrodes, which may indicate that they are not providing adequate satisfaction in industrial production, in particular, of chlorine. Other recent patents which have issued to our assignee are U.S. Pat. Nos. 3,917,525; 4,010,091; and 4,115,239.

It has now been found that it is possible to produce electrodes employing no precious metals, but employing only readily obtained compounds of moderate price in coatings which have an excellent life when employed in the electrolysis of alkali chlorides.

It is, accordingly, an object of the present invention to provide novel and effective electrodes for the electrolysis of alkali chlorides which do not require the use of the precious metals.

It is a further object of the invention to provide useful and effective electrodes for electrolytic cells which employ only relatively inexpensive metals.

Other objects of the invention will be apparent to those skilled in the art from the present disclosure.

GENERAL DESCRIPTION OF THE INVENTION

The invention concerns an electrode for electrolytic cells, in particular, those employed in the electrolysis of sodium chloride, formed of a valve-metal substrate and a coating comprising cobalt oxide, the electrode being characterized by the fact that the cobalt oxide is defined by the formula $Co_{3-x}O_4$ in which x is between $10^{-1}$ and $10^{-2}$ and by the fact that the coating also contains a titanium compound and at least one element of the group formed of oxygen and hydrogen, the valence of the titanium in this compound being less than 3.

The titanium compound may be an oxide of the formula $TiO_x$ in which x is between 0.45 and 1.2, and preferably between 0.9 and 1.1. It may also be a hydride of the formula $TiH_x$ in which x is between 0.1 and 2 and preferably between 1.8 and 2. These compounds in which the titanium has a valence of less than its maximum valence exhibit better conductivity. Among titanium compounds which may be employed are substances defined by the formula $TiO_xH_y$ in which x is between 2 and 1 and y is between 0 and 0.1. These compounds are described, in particular, in the "Transactions of the Metallurgical Society of AIME," Vol. 224, October 1962, pp. 928–935.

The cobalt oxide is obtained preferably by thermal decomposition of cobalt nitrate, in particular, $Co(NO_3)_2 \cdot 6H_2O$, while flushing with air at a temperature of between about 200° and 600° C., and preferably between about 300° and 400° C.

The substrate of the electrode is a valve-metal, i.e., a metal of this well-known class comprising titanium, tantalum, molybdenum, zirconium, niobium, and tungsten. Titanium is the preferred metal of this class. It may be in the form of a smooth metal plate, or netting, or be obtained by powder sintering.

The titanium oxide or hydride can be initially deposited on the substrate, and in direct contact with it. These compounds of titanium can also be deposited on the substrate at the same time as the cobalt oxide. They are then dispersed in the layer of said cobalt oxide.

The amount of cobalt oxide deposited is preferably from about 15 to 40 mg./cm$^2$. A larger amount can be used, but does not have any beneficial effect. In the event that a prior deposit of titanium oxide or hydride has been effected on the substrate, it is necessary, for the satisfactory operation of the electrode, that at least one face of the substrate be covered by this compound over at least 5 percent of its surface; the thickness of the layer of titanium compound is desirably greater than about 0.5 microns.

In case of direct deposit on a valve-metal substrate of a mixture of titanium and cobalt compounds, the atomic ratio Ti/Co should desirably be between about 0.6 and 20, and preferably between about 6 and 11. These last-mentioned values are, therefore, not mandatory, but it has been found that for a ratio less than about 6, there is a drift of the voltage after several hundreds of hours of electrolysis of sodium chloride under customary industrial conditions when using these electrodes. Also, the adherence of the coating is poor when the ratio is greater than about 11.

The prior deposition of titanium suboxide on a titanium substrate is described in the French patent application published under No. 2,259,921. The hydride can also be formed in situ by hydrogenation of solid or porous titanium. The depositing of these compounds at the same time as the titanium oxide can be effected advantageously by placing the previously prepared titanium suboxide or hydride in suspension in a solution of cobalt salt. The substrate is coated with this suspension and then dried and finally heated to a temperature which permits the decomposition of the salt into oxide. This operation is repeated several times until the desired weight of cobalt and titanium is obtained. The proportion of titanium compound in the cobalt salt solution is, of course, selected accordingly. The preferred cobalt salt is the nitrate, which is decomposed at a temperature of about 200° to 600° C., and preferably about 300° to 400° C., while flushing with air, whether it is deposited alone or simultaneously with the titanium compound.

The titanium oxide in the coating, whose particle size is preferably from about 0.5 to 20 microns, can be prepared separately or else deposited directly on the substrate which has been previously cleaned and washed, by means of a plasma torch, either from the dioxide with, as carrier and plasma-forming gas, a mixture of hydrogen and argon, or from powdered titanium with a mixture of oxygen and argon, or from a mixture of titanium dioxide and/or hydride with an argon plasma. The method described in the above-mentioned French patent application for forming the suboxide on the substrate can be used in order to form it separately.

The titanium hydride can be prepared and deposited by very different methods, such as those described in U.S. Pat. Nos. 2,401,326 and 3,732,157. The hydride can also be formed chemically in a 4 to 13 normal hydrochloric acid solution or electrochemically. Titanium dioxide can also be reduced by elements such as magnesium or carbon in the presence of hydrogen or by a hydride such as calcium hydride.

Analyses carried out, in particular, by X-ray have shown that the coatings of the invention were actually a mixture of cobalt oxide or a composition close to $Co_3O_4$ and of titanium suboxide or hydride; the substantial presence of a mixed compound of these two metals has never been observed.

This presence of a simple mixture confers an even more surprising character to the invention, since experience has shown that a valve-metal substrate coated with cobalt oxide alone lasted only a few hundred hours while this same substrate covered with any titanium oxide or hydride did not possess acceptable electrical properties for the electrolysis of sodium chloride. The remarkable life in such an electrolysis, consisting of several thousands of hours under high current densities, together with the simplicity and low cost of these electrodes, constitutes a substantial contribution to the field of electrolysis.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLE 1

A substrate formed of a sintered titanium plate covered with titanium suboxide of a thickness of about 1 mm., as described in the French patent application published under No. 2,259,921, is coated above the layer of titanium suboxide, by means of a brush, with a cobalt nitrate solution. This solution is obtained by dissolving 1 g. of $Co(NO_3)_2.6H_2O$ in 2 cc. of a mixture of an equal volume of water and isopropyl alcohol. This resulting substrate, coated in this manner, is dried in an oven and then heated for 10 minutes at 350° C., while being flushed with air. This sequence of operations is repeated until 37 mg. of cobalt oxide/cm.$^2$ are obtained. The resulting plate coated in this manner is used as anode in a diaphragm electrolysis cell containing an NaCl brine of 300 g./l. (grams per liter) of a pH of 4.5 and a temperature of 85° C. The voltage, referred to a saturated calomel electrode (saturated calomel electrode voltage), measured after 3000 hours of operation, is 1077 mV, with a current density of 25 amps/dm.$^2$. With a current density of 200 amps/dm.$^2$ after 600 hours of operation, no degradation of the electrode is observed.

EXAMPLE 2

A solution of 1 g. of $Co(NO_3)_2.6H_2O$ in 1 cc. of water and 1 cc. of isopropyl alcohol in which there has been suspended a $TiO_x$ powder (x=about 1) of a particle size of between 0.5 and 20 microns is deposited on a titanium plate which has been previously sanded and washed. The Ti/Co atomic ratio in this suspension is 6. The treatment of the coated plate is effected in accordance with the method described in Example 1, above, and this resulting plate is used as electrode, under the same conditions as those indicated in preceding Example 1 (current density: 25 amps/dm.$^2$). The amount of cobalt oxide deposited is 27 mg./cm.$^2$. The saturated calomel electrode voltage measured after 957 hours of operation is 1090 mV.

EXAMPLE 3

The same procedure employed in the preceding example is repeated, the oxide being replaced by the hydride $TiH_x$ (x=1.9) with different Ti/Co ratios. The weight of cobalt oxide is 37 mg./cm.$^2$.

The results obtained in resulting series of electrodes with the conditions of the preceding examples are given in Table 1, below.

TABLE 1

| Atomic Ratio Ti/Co | Time of Test in hours | Voltage referred to saturated calomel electrode in millivolts |
|---|---|---|
| 10 | 1100 | 1095 |
| 6 | 1870 | 1165 |
| 3 | 750 | 1115 |
| 1 | 820 | 1152 |

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An electrode for electrolysis of sodium chloride, having absent any precious metal, comprising a valve-metal substrate and a coating containing a cobalt oxide, said cobalt oxide corresponding to the formula $Co_{3-x}O_4$, in which x is between about 0.1 and 0.01, said coating comprises cobalt oxide and a compound of titanium with an element selected from the group consisting of hydrogen and oxygen, the valence of the titanium in said compound being less than 3.

2. An electrode according to claim 1, wherein the titanium compound is an oxide of the formula $TiO_x$, in which x is between about 0.45 and 1.2.

3. An electrode according to claim 1, wherein the titanium compound is an oxide of the formula $TiO_x$, in which x is between about 0.9 and 1.1.

4. An electrode according to claim 1, wherein said titanium compound is a hydride of the formula $TiH_x$, which x is between about 0.1 and 2.

5. An electrode according to claim 1, wherein said titanium compound is a hydride of the formula $TiH_x$, in which x is between about 1.8 and 2.

6. An electrode according to claim 1, wherein the amount of cobalt oxide is from about 15 to 40 mg./cm.$^2$.

7. An electrode according to claim 2, characterized by the fact that the cobalt oxide is formed by the thermal decomposition of cobalt nitrate.

8. An electrode according to claims 1, 2, 3, 4, 5, 6, or 7, wherein the compound of titanium comprises a layer in direct contact with the valve-metal substrate.

9. An electrode according to claims 1, 2, 3, 4, 5, or 6, wherein the compound of titanium is dispersed in the layer of cobalt oxide.

10. An electrode according to claims 1, 2, 3, 4, 5, or 6, wherein the ratio of the number of titanium atoms to the number of cobalt atoms in the coating is between about 0.6 and 20.

11. An electrode according to claims 1, 2, 3, 4, 5, or 6, wherein the ratio of the number of titanium atoms to the number of cobalt atoms in the coating is between about 6 and 11.

* * * * *